US005151156A

United States Patent [19]

Schiel

[11] Patent Number: 5,151,156

[45] Date of Patent: Sep. 29, 1992

[54] SUCTION ROLL WITH DEFLECTOR PIECES IN THE HOLES, FOR A DRYER GROUP OF A PAPER MAKING MACHINE

[75] Inventor: Christian Schiel, Heidenheim, Fed. Rep. of Germany

[73] Assignee: J. M. Voith GmbH, Fed. Rep. of Germany

[21] Appl. No.: 780,632

[22] Filed: Oct. 23, 1991

[30] Foreign Application Priority Data

Oct. 23, 1990 [DE] Fed. Rep. of Germany ..... 4033597

[51] Int. Cl.[5] ..... D21F 5/00; D21F 5/14

[52] U.S. Cl. ..... 162/368; 34/117; 34/120; 162/372; 29/121.1

[58] Field of Search ..... 162/368-370, 162/372; 34/115, 116, 117, 120; 29/121.1

[56] References Cited

U.S. PATENT DOCUMENTS 3,305,439 2/1967 Siegel ..... 162/368
5,022,163 6/1991 Ilvespaa et al. ..... 162/370
5,024,729 6/1991 Kuhasalo et al. ..... 162/368

*Primary Examiner*—Karen M. Hastings
*Attorney, Agent, or Firm*—Osterlenk, Faber, Gerb & Soffen

[57] ABSTRACT

The suction roll of a dryer group is in the path of the web and of the web support belt from an upstream dryer cylinder to a downstream dryer cylinder. The suction roll has an annular roll shell having a plurality of radial holes and being free of stationary inserts at least over the predominant part of the length of the roll shell. A hollow roll journal at at least one end of the suction roll connects vacuum into the suction roll and to the radial holes. In at least some of the holes there are respective deflector pieces. Each extends a short radial distance into the inside of the roll shell over a short radial portion. The deflector piece has a continuous channel which extends radially inward through the hole toward the inside of the roll in a direction substantially parallel to the direction of extension of the hole and the radially inward portion of the channel is curved in the direction contrary to the direction of rotation of the roll shell.

16 Claims, 1 Drawing Sheet

SUCTION ROLL WITH DEFLECTOR PIECES IN THE HOLES, FOR A DRYER GROUP OF A PAPER MAKING MACHINE

BACKGROUND OF THE INVENTION

The present invention relates to a suction roll, which is particularly useful for a single-wire dryer group of a paper making machine. In such a dryer group, a web, for instance, a paper web, which is to be dried travels, together with a porous support belt, alternately over dryer cylinders and suction rolls. The suction rolls serve primarily as reversing rolls for the support belt and for the web which is carried along by the support belt. The web of paper is pressed against the dryer cylinders by the support belt. As the support belt travels over the reversing rolls, however, the support belt is between the outside of the reversing rolls and the paper web. At the reversing rolls, the web must be drawn by suction against the support belt and in opposition to the centrifugal force which acts on the web. For this reason, the reversing rolls are developed as suction rolls.

The invention relates to a suction roll which does not include the usual suction box. In known box suction rolls, a stationary suction box extends through the hollow roll body. A suction box-less suction roll, of which the invention is an example, is known from EP-A 0332599 which is equivalent to U.S. Pat. No. 5,022,163. With this type of suction roll, it has been found that the consumption of energy for producing a given vacuum on the outside of the shell of the roll increases with the operating speed of the machine that is, increases with the speed of rotation of the suction rolls.

SUMMARY OF THE INVENTION

The object of the invention is to develop a suction box-less suction roll to reduce the consumption of energy needed to generate the necessary vacuum or suction on the outside or periphery of the shell of the roll, particularly at the high operating speeds of modern paper making machines, namely about 1,000 to 2,000 meters per minute.

Another object is to eliminate or at least reduce the generation of a potential vortex within the roll shell as a result of the air blowing into the rotating shell.

The invention is based on the discovery that as the speed of rotation of the suction roll increases, the consumption of energy for producing the suction or vacuum at the periphery of the annular shell of the roll is considerably increased because the air flowing radially through the suction air inlet holes in the shell of the roll is also imparted a circumferential component in the direction of rotation of the roll shell which is of approximately the same order of magnitude as the radial velocity of flow. The resultant of the radial and circumferential components of the velocity of the incoming air flow produces a potential vortex within the suction roll which causes a considerable increase in the power required for the blower.

The production of the potential vortex can be at least substantially prevented by inlet air deflector pieces placed in at least some of the holes in the roll shell. The annular roll shell is provided with a plurality of radial suction air inlet holes through it which are arrayed circumferentially around the roll shell and at least over the predominant part of its length. In at least some of the holes, there is held, e.g. by force fitting or by bonding, a respective deflector piece which extends at least partially through the hole and extends a relatively short radial distance into the inside of the annular roll shell. Through each deflector piece there extends a continuous channel which communicates from the outside of the roll shell into the inside. The part of the channel that passes through the roll shell extends at least substantially parallel to the hole in the shell. In at least the radially inward part of the deflector piece inside the roll shell and possibly a short distance radially into the hole in the shell, the channel has a rounded curvature that is directed contrary to the direction of rotation of the roll shell. The curved section covers an angle of between 50° and 90°, preferably between 65° and 75° and particularly 70°.

The deflector pieces and their curved channels provide a direction of emergence of the air from the channels, which direction is approximately opposite the direction of rotation of the roll shell, and is a so-called "relative emergence direction". The relative emergence direction of the air and the circumferential direction of roll shell rotation produce an absolute emergence direction which is approximately radial. This so greatly reduces the speed of rotation of the potential vortex that the vortex impedes the radial movement of the air only slightly if at all. Up to 40% less blower power than previously is required in order to produce a given vacuum on the periphery of the suction roll.

Other objects and features of the invention are described below with reference to an embodiment shown in the drawings.

DESCRIPTION OF A PREFERRED EMBODIMENT

Figure 1:
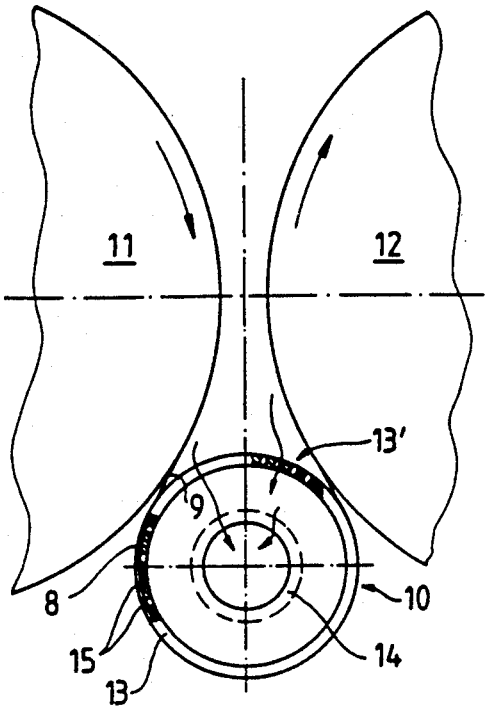
FIG. 1 shows a portion of a single-wire dryer end of a paper making machine, the portion having a suction roll.

In a single tier single wire dryer group of a paper making machine, the web passes through a dryer section having a plurality of dryer cylinders in a generally aligned straight row which alternate with reversing suction rolls, and the web, carried by a support belt or wire, moves from each dryer cylinder, over a subsequent reversing roll to the next dryer cylinder. In the portion of such a dryer group shown in FIG. 1, a suction roll 10 is arranged between two dryer cylinders 11 and 12. The direction of rotation of each dryer cylinder is indicated by respective arrows. The dryer cylinder 11 is arranged in front i.e. upstream, of the reversing suction roll 10. A support belt 9, developed as a porous wire screen, known as a wire, travels in a known manner from the dryer cylinder 11 onto the annular shell 13 of the suction roll 10 and from there to the following dryer cylinder 12. A web of paper (not shown), which travels together with the support belt 9, is disposed on the side of the belt 9 which has direct contact with the two dryer cylinders 11 and 12. In the region of the suction roll 10, the web of paper is on the outside of the support belt 9.

The suction roll 10 is free of stationary inserts within the roll and has at least one hollow roll journal 14 which is open radially outward toward the inside of the roll shell. A source of vacuum can be connected to the journal. The annular roll shell 13 has a plurality of radial holes 15 in the roll shell through which vacuum is propagated to the outside of the roll shell. The holes 15 are continuous holes through the shell and are arrayed circumferentially around the shell and at least over the predominant part of the axial length of the shell. Simple continuous holes can be provided, as indicated at one arcuate segment, at 13' in FIG. 1. As an alternative, circumferential grooves 8 can be provided in the outer surface of the roll shell 13, into which grooves the holes 15 debouch, as indicated at another arcuate segment in FIG. 1.

Figure 4:
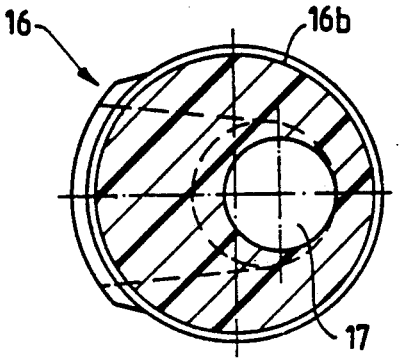
FIG. 4 is a section through the deflector piece along the line IV—IV of FIG. 2.
Figure 2:
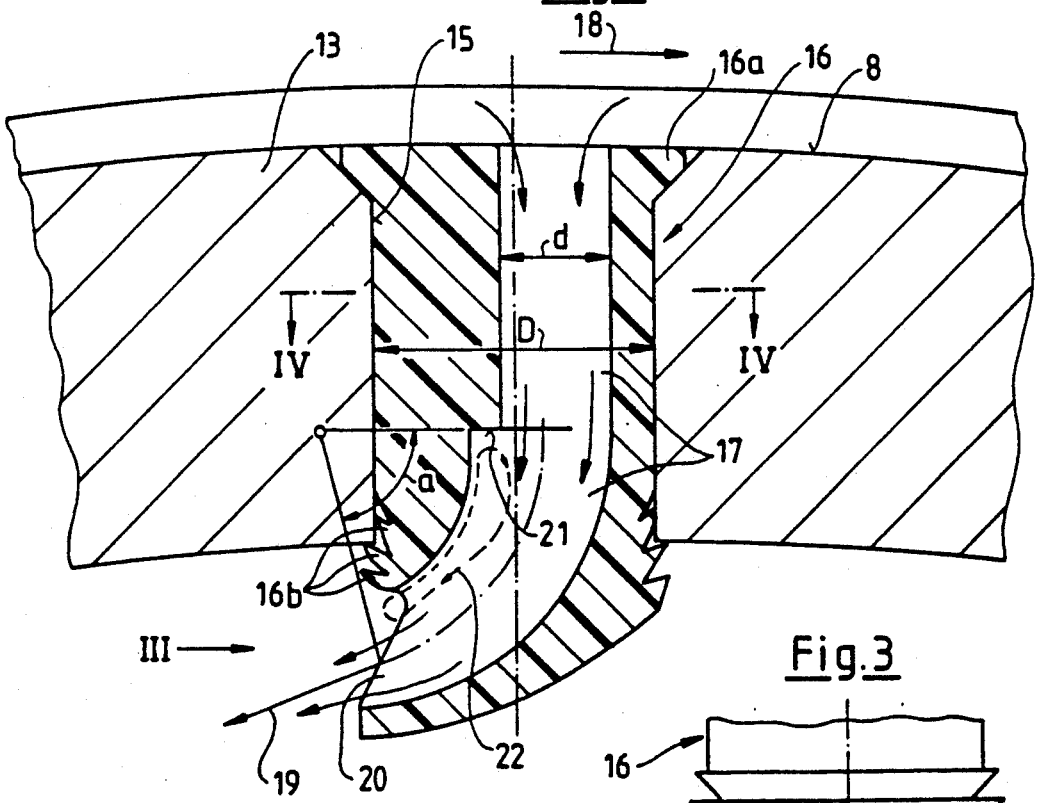
FIG. 2 is a partial section, shown greatly enlarged as compared with actual size, through the shell of the suction roll, together with a deflector piece.
Figure 3:
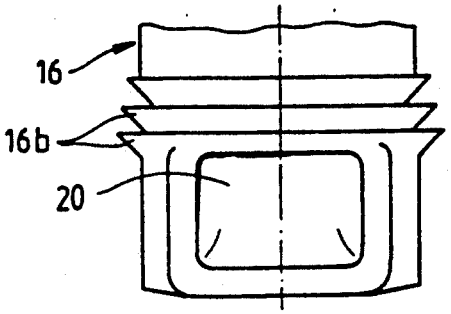
FIG. 3 is a partial view of the deflector piece, seen in the direction of the arrow III in FIG. 2.

A respective deflector piece 16, shown in detail in FIGS. 2 to 4, is preferably inserted in each hole 15. Each deflector piece 16 is predominately cylindrical in cross-section, with the shape corresponding to the size and shape of the hole 15 in which the deflector piece is disposed. The deflector piece has a collar **16*l* developed on its inlet, radially outer end to cooperate with the radially outer side of the shell at the hole 15 and hold the piece 16 in position. Toward its outlet, radially inner end, the deflector piece 16 extends for a distance into the inside of the roll. There the piece 16 has a few barbs 16*b* which hold the deflector piece against moving outward under centrifugal force from within the rotating roll shell 13. The barbs 16*b*** can be developed as annular beads.

The deflector pice 16 has a continuous channel 17 through it which extends radially of the roll shell in the direction toward the inside of the roll. The radially outward part of the channel extends approximately parallel to the radial hole 15. The channel gradually curves in the direction opposite the direction 18 of rotation of the roll shell 13 starting where the piece 16 is inside the roll shell and extending through the part of the piece that extends radially inside the roll shell. The curved part of the channel 17 has a center about which it has a curvature angle of between 50° and 90°, preferably between 65° and 75° and as shown, of, for instance, 70°. This produces the relative emergence direction of the air indicated by the arrow 19. With due consideration of the direction of roll shell rotation shown by arrow 18, a substantially radial absolute direction of emergence of the air results.

The hole 15 has an axis through the center of its cross section. In FIGS. 2 and 4, the part of the channel 17 that is substantially parallel to the hole 15 is displaced with respect to the axis of the hole downstream in the direction of rotation 18 of the roll shell 13. The emergence opening at 20 of the deflector piece 16 is preferably approximately rectangular in cross section, as seen in FIG. 3. At the transition between the straight and the curved parts of the channel 17 or in front, i.e. upstream, or behind, i.e. downstream, of this transition, a step-like increase in the cross section, in the form of a step 21, can be provided. This step 21 is present substantially only in the region on the inside of the curvature of the channel and, therefore, on the side of the channel which is opposite the direction of rotation 18. The channel wall does not have a step in the region of the outside of the curvature. As a result, the center line of the channel effects a "jump". In the region of the inside of the curvature, a vortex-like secondary flow is produced, which is indicated by dashed line 22. This secondary flow effects a well defined detachment of the primary flow of air from the channel wall downstream of the step 21 and thus reduces the pressure losses.

The deflector piece 16 is made of an elastic plastic material It is force-fitted or glued in the hole 15. In FIG. 2 the diameter D of the hole 15 amounts to about 10 mm. The diameter d of the channel 17 is about 4 mm.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A suction roll for a dryer group of a paper making machine, the suction roll having a direction of rotation and comprising an annular roll shell which is rotatable around its axis, the roll shell being provided with a plurality of substantially radial, continuous holes through the shell which are arrayed circumferentially around the shell and at least over the predominant part of the axial length of the shell; the roll shell being hollow and the hollow of the roll shell being connectable with a source of vacuum such that the vacuum source draws suction through the holes in the roll shell;

a respective deflector piece in at least some of the radial holes, each deflector piece including a portion extending a short radial distance inside the annular shell of the roll; each deflector piece including a continuous channel therethrough extending from an end that is toward the radial exterior of the shell toward another end that is radially inside of the shell, the channel extending through the shell in a direction at least substantially parallel to the direction of the respective hole, the portion of the channel radially inward of the roll shell being curved in a direction contrary to the direction of rotation of the roll shell.

2. The suction roll of claim 1, wherein the suction roll is free of stationary inserts within the roll.

3. The suction roll of claim 1, further comprising a hollow roll journal at at least one axial end of the suction roll and the hollow roll journal being open radially toward the inside of the roll shell, the source of vacuum being connectable to the hollow roll journal.

4. A dryer group for a paper making machine, the dryer group comprising a first dryer cylinder in the path of a paper web to be dried;

a second dryer cylinder downstream of the first dryer cylinder in the path of the web to be dried; and the suction roll of claim 1 disposed between the first and the second dryer cylinders along the path of the web to be dried, such that the web passes from the first dryer cylinder to wrap around the suction roll and then to the second dryer cylinder.

5. The dryer group of claim 4, further comprising a web support belt which wraps partially around the first dryer cylinder and then extends to and wraps partially around the suction roll and then extends to and wraps partially around the secondary cylinder, the support belt being adapted to support the web to be dried in the dryer group such that the web is in direct contact with the first and the second dryer cylinders and the web is on the side of the support belt that is away from the suction roll over which the support belt is then passing.

6. The suction roll of claim 1, wherein the curved portion of the channel through the deflector piece is curved over an angle of curvature of between 50° and 90°.

7. The suction roll of claim 6, wherein the angle of curvature is between 65° and 75°.

8. The suction roll of claim 1, wherein each radial hole having a deflector piece therein has an axis of the hole which is generally central in the cross section of the hole; the deflector piece being so positioned and the channel through the deflector piece being so shaped and positioned that the part of the channel which is substantially parallel to the direction of the hole is displaced with respect to the axis of the hole forward and the downstream in the direction of rotation of the roll shell.

9. The suction roll of claim 8, wherein the channel through the deflector piece has a step-like increase in the cross-section thereof in the portion along the channel that is at the inside of the curvature of the channel and that is also opposite the direction of rotation of the roll shell.

10. The suction roll of claim 9, wherein the curved portion of the channel has an upstream end which is radially outward and a downstream end, and the step-like increase in the cross-section of the channel is toward the upstream end of the curved portion.

11. The suction roll of claim 1, wherein the deflector pieces are comprised of an elastic plastic material and the deflector pieces are force fitted into the holes of the roll shell.

12. The suction roll of claim 1, wherein the deflector pieces are bonded in the holes of the roll shell.

13. The suction roll of claim 1, wherein each deflector piece portion that extends out of the radially inner end of the respective hole and in the roll shell includes means which prevent radial displacement of the deflector piece.

14. The suction roll of claim 13, wherein the radial displacement prevention means comprise barbs on the deflector pieces portion.

15. The suction roll of claim 1, wherein the channel through the deflector piece has a step-like increase in the cross-section thereof in the portion along the channel that is at the inside of the curvature of the channel and that is also opposite the direction of rotation of the roll shell.

16. The suction roll of claim 15, wherein the curved portion of the channel has an upstream end which is radially outward and a downstream end, and the step-like increase in the cross-section of the channel is toward the upstream end of the curved portion.

* * * * *